US012287184B2

(12) United States Patent
Mahnke

(10) Patent No.: US 12,287,184 B2
(45) Date of Patent: Apr. 29, 2025

(54) AMMUNITION CARTRIDGE CASING

(71) Applicant: Next Level Cartridge Company LLC, Post Falls, ID (US)

(72) Inventor: Joshua Mahnke, Post Falls, ID (US)

(73) Assignee: Next Level Cartridge Company, LLC, Post Falls, ID (US)

( * ) Notice: Subject to any disclaimer, the term of this patent is extended or adjusted under 35 U.S.C. 154(b) by 0 days.

(21) Appl. No.: 17/863,147

(22) Filed: Jul. 12, 2022

(65) Prior Publication Data

US 2023/0016440 A1 Jan. 19, 2023

Related U.S. Application Data

(60) Provisional application No. 63/220,919, filed on Jul. 12, 2021.

(51) Int. Cl.

| | |
|---|---|
| ***F42B 5/285*** | (2006.01) |
| ***F42B 33/00*** | (2006.01) |
| ***F42C 19/08*** | (2006.01) |

(52) U.S. Cl.

CPC ..... *F42B 5/285* (2013.01); *F42B 33/001* (2013.01); *F42C 19/083* (2013.01)

(58) Field of Classification Search

CPC .... F42B 5/26; F42B 5/28; F42B 5/285; F42B 5/307; F42B 33/00; F42B 33/001; F42C 19/08; F42C 19/083

USPC ..... 102/464–470

See application file for complete search history.

(56) References Cited

U.S. PATENT DOCUMENTS

| | | | | |
|---|---|---|---|---|
| 3,842,739 A * | 10/1974 | Scanlon | F42B 5/073 102/467 |
| 3,874,294 A | 4/1975 | Hale | |
| 3,977,326 A * | 8/1976 | Anderson | F42B 5/307 102/467 |
| 10,866,072 B2 | 12/2020 | Imhoff | |

(Continued)

FOREIGN PATENT DOCUMENTS

| | | |
|---|---|---|
| HU | 313560 | 6/1929 |
| WO | WO 2023/003728 A2 | 1/2023 |
| WO | PCT/US2022/036866 | 1/2024 |

OTHER PUBLICATIONS

PCT Written Opinion.

*Primary Examiner* — James S Bergin

(74) *Attorney, Agent, or Firm* — Keith D. Grzelak; Wells St. John P.S.

(57) ABSTRACT

An ammunition cartridge casing is provided having a primer body and a casing body. The primer body has an inner primer portion and an outer primer portion configured to nest in conformance with an outer surface of the inner primer portion. The outer surface of the inner primer portion provides a circumferential trench having a radially outwardly extending circumferential wall portion contiguous with an axially extending circumferential wall portion. The casing body has a distal end portion and a proximal end portion. The proximal end portion of the casing body is interposed between the inner primer portion and the outer primer portion within the trench having an interlocked axially extending circumferential portion and an interlocked radially outwardly extending disc portion of the casing body entrapped between the inner primer portion and the outer primer portion. A method is also provided.

24 Claims, 6 Drawing Sheets

(56) References Cited

U.S. PATENT DOCUMENTS

| | | | | |
|---|---|---|---|---|
| 11,067,370 | B2 * | 7/2021 | Imhoff | F42B 5/285 |
| 2019/0242679 | A1 | 8/2019 | Viggiano et al. | |

* cited by examiner

AMMUNITION CARTRIDGE CASING

CROSS REFERENCE TO RELATED APPLICATIONS

This patent application claims priority to and the benefit of U.S. Provisional Patent Application Ser. No. 63/220,919 filed Jul. 12, 2021, entitled "Ammunition Casing and Method".

TECHNICAL FIELD

This disclosure pertains to the field of ammunition. More particularly, this disclosure relates to ammunition cartridge casings having at least two component parts.

BACKGROUND OF THE INVENTION

Traditional cartridge casings for ammunition are made from brass. Recently, attempts have been made to change materials and cartridge casings have been made having at least two components and including a junction or connecting joint. Improvements are needed in order to provide for increased combustion pressures in such cartridge casings to meet the demands of future ammunition performance requirements.

SUMMARY OF THE INVENTION

An ammunition cartridge casing is provided for use in manufacturing ammunition. A joint is used to lock together a multiple component base, or case rim with a cartridge casing wall that has geometric features to lock together the casing wall and the base in assembly. A method of manufacturing an ammunition cartridge casing and ammunition is also provided.

According to one aspect, an ammunition cartridge casing is provided having a primer body and a casing body. The primer body has an inner primer portion and an outer primer portion configured to nest in conformance with an outer surface of the inner primer portion. The outer surface of the inner primer portion provides a circumferential trench having a radially outwardly extending circumferential wall portion contiguous with an axially extending circumferential wall portion. The casing body has a distal end portion and a proximal end portion. The proximal end portion of the casing body is interposed between the inner primer portion and the outer primer portion within the trench having an interlocked axially extending circumferential portion and an interlocked radially outwardly extending disc portion of the casing body entrapped between the inner primer portion and the outer primer portion.

According to another aspect, a method is provided for forming an ammunition cartridge, including: providing a primer body having an inner primer portion and an outer primer portion and a casing body having a proximal portion configured to nest in conformance with an outer surface of the inner primer portion, the outer surface of the inner primer portion providing a circumferential trench having a radially outwardly extending circumferential wall portion contiguous with an axially extending circumferential wall portion; inserting the proximal portion of the casing body within the circumferential trench between the inner primer portion and the outer primer portion; and mechanically urging together the inner primer portion, the proximal portion of the casing body and the outer primer portion to impart a mechanical interlock.

BRIEF DESCRIPTION OF THE DRAWINGS

Preferred embodiments of the disclosure are described below with reference to the following accompanying drawings.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

Figure 1:
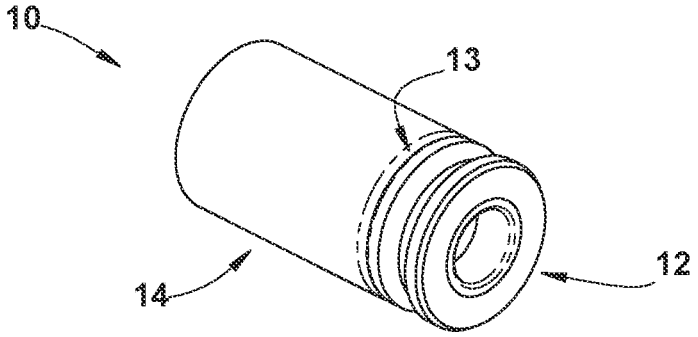
FIG. 1 is a perspective view from above and rearward of a first ammunition cartridge casing.

FIG. 1 is a partial perspective view from above and rearward of a first ammunition cartridge casing 10 having a multiple part base, or case rim 12, a casing body component 14 and a joint 13 formed to join together the base 12 and the body component 14. Joint 13 is provided to enable construction of cartridge casing 10 from multiple components and/or materials that optimize performance from one or more of weight, internal combustion pressures, conductivities and material/geometry strengths. Cartridge casing 10 is used in the assembly of ammunition where a bullet, powder and primer are added to casing 10.

Figure 2:
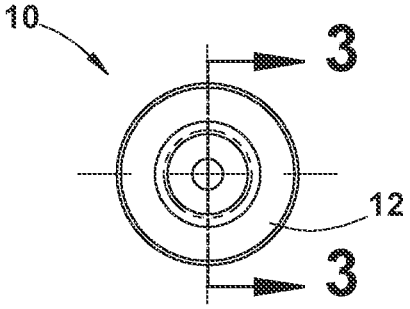
FIG. 2 is a rear end view of the cartridge casing of FIG. 1.

FIG. 2 is a rear end view of the cartridge casing 10 of FIG. 1. Case rim, or primer base 12 is shown in end view.

Figure 3:
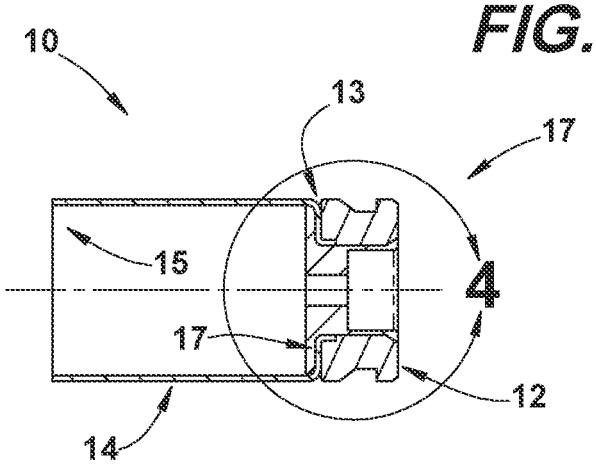
FIG. 3 is a vertical sectional view taken along line 3-3 of FIG. 2.

FIG. 3 is a vertical sectional view taken along line 3-3 of FIG. 2 showing detailed construction of joint 13 for ammunition casing 10. More particularly, casing body component, or wall 14 is formed at a proximal end to be locked within individual components making up multiple part base 12 to form connection joint 13 between component 14 and base 12. Casing body 14 has a distal end portion 15 and a proximal end portion 17. A projectile is received on distal end portion 15 of casing body 14.

Figure 4:
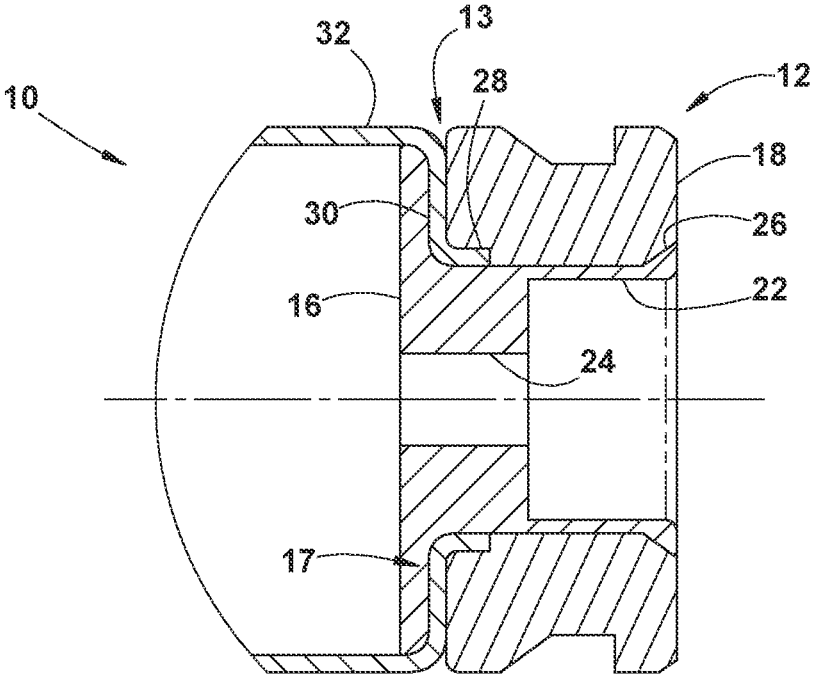
FIG. 4 is an enlarged sectional view from encircled region 4 of FIG. 3.

FIG. 4 is an enlarged sectional view from encircled region 4 of FIG. 3 showing greater details for joint 13 formed between component 14 and base 12 for cartridge casing 10. A proximal end portion 17 of component 14 forms an axially extending cylindrical leg, or ring portion 28. Portion 28 transitions into a radially outwardly extending disk-shaped flange 30 extending ninety degrees from portion 28, forming a right angle radius bend. Optionally, flange 30 can have angles deviating relative to ninety degrees from portion 28. Ring portion 28 and axial portion 30 cooperate to form a compound geometry formed end web of casing wall 32 and are trapped, or locked together in assembly between a cylindrical inner primer body, or inner primer portion 16 and a cylindrical outer rim body, or outer primer portion 18. One of several manufacturing processes are used to press together body 16, portions 28 and 30 (of casing wall 32) and body 18 to form a locked together assembly desirable to realize structural integrity when propellant within casing 32 is ignited to propel a bullet (not shown) when assembled together and used as ammunition.

As shown in FIG. 4, inner body 16 has a primer hole 22 communicating with a flash hole 24. Depending on the manufacturing process, primer hole 22 and flash hole 24 can be stretched radially outwardly to swage, or work inner body 16 against ring portion 28 and axial portion 18 of casing wall 32 as outer rim body 18 is worked in a radial inward direction. A radially outwardly extending rim flange 26 can be worked, or formed during manufacturing in a distal end of body 16 along an outer edge of primer hole 22 which serves to lock outer rim body 18 onto inner body 16.

Figure 5:
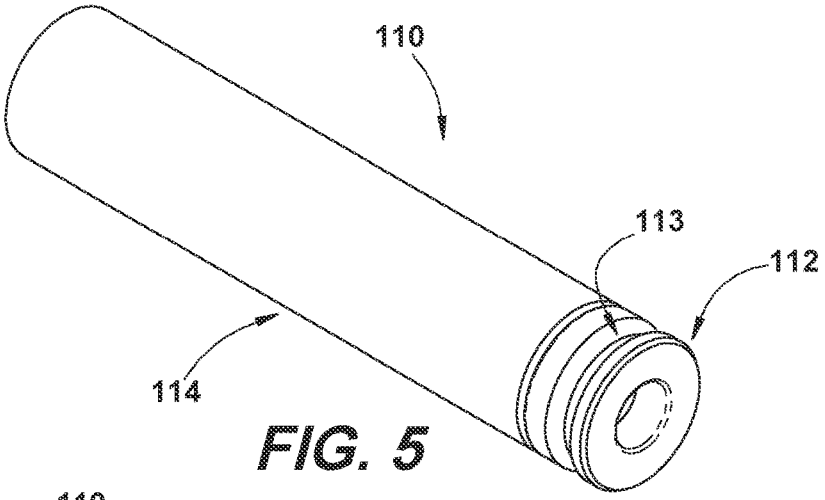
FIG. 5 is a perspective view from above and rearward of a second ammunition cartridge casing.

FIG. 5 is a perspective view from above and rearward of a second ammunition cartridge casing 110 having a multiple part base, or case rim 112, a casing body component 114 and a joint 113 formed to join together the base 112 and the body component 114. Joint 113 is provided to enable construction of cartridge casing 110 from multiple components and/or materials that optimize performance from one or more of weight, internal combustion pressures, conductivities and strengths. For example, the components of primer base 112 can be manufactured from a different strength (or material property) material, such as stainless steel or some other suitable higher strength alloy than for casing body 132 which can be manufactured from an alternative material including a more ductile and lower strength material, or a higher strength material. The same is true for alternative constructions shown in FIGS. 1-23 herein. Cartridge casing 110 is used in the assembly of ammunition where a bullet, powder and primer are added to casing 110.

Figure 6:
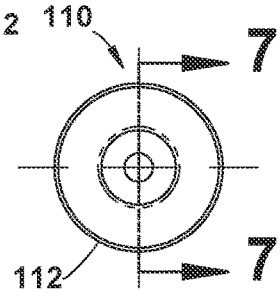
FIG. 6 is a rear end view of the cartridge casing of FIG. 5.

FIG. 6 is a rear end view of the cartridge casing 110 of FIG. 1. Case rim, or primer base 112 is shown in end view.

Figure 7:
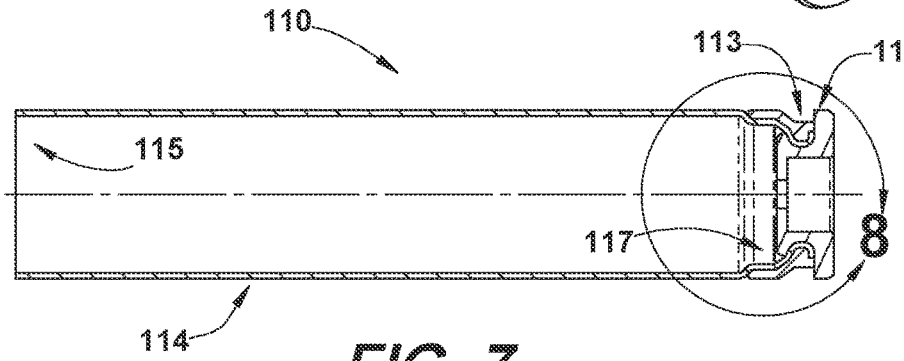
FIG. 7 is a vertical sectional view taken along line 7-7 of FIG. 6.

FIG. 7 is a vertical sectional view taken along line 7-7 of FIG. 6 showing detailed construction of joint 113 for ammunition casing 110. More particularly, casing body component, or wall 114 is formed at a proximal end to be locked within individual components making up multiple part base 112 to form connection joint 113 between component 114 and base 112. Casing body 114 has a distal end portion 115 and a proximal end portion 117. A projectile is received on distal end portion 115 of casing body 114.

Figure 8:
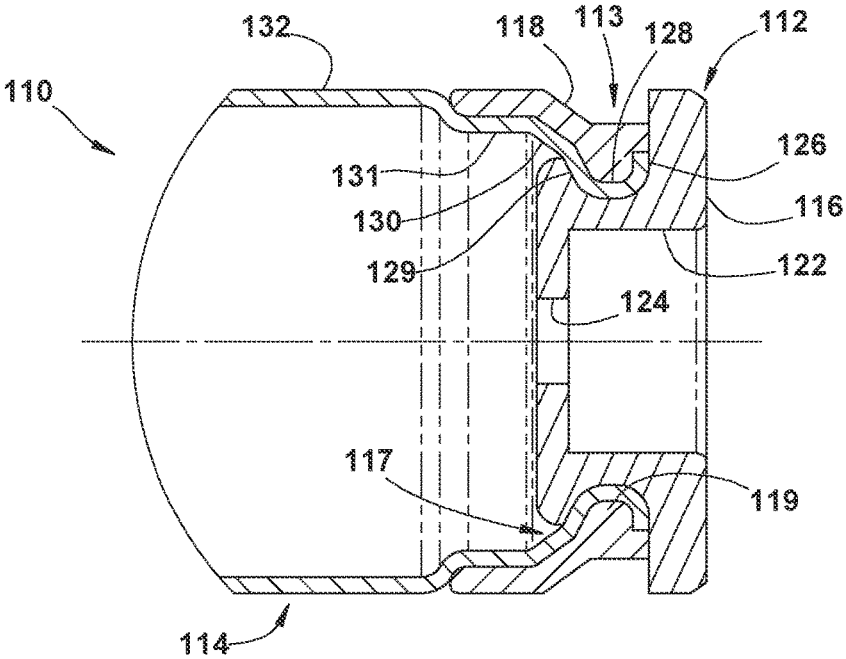
FIG. 8 is an enlarged sectional view from encircled region 8 of FIG. 7.

FIG. 8 is an enlarged sectional view from encircled region 8 of FIG. 7 showing greater details for joint 113 formed between component 114 and base 112 for cartridge casing 110. A proximal end portion 117 of component 114 forms an axially extending cylindrical leg, or ring portion 128. Component 114 comprises a stepped down casing wall 132 having a series of radius transition plural transitions forming progressive reduced diameter portions including axially extending cylindrical portion 131, frustoconical portion 130, frustoconical flange 129, cylindrical ring portion 128 and terminating rim flange 126. Flanges 129 and 126 and ring portion 128 cooperate to form a compound geometry formed by an end web of casing wall 132 and are trapped, or locked together in assembly between a cylindrical inner primer body 116 and a cylindrical outer rim body 118. One of several manufacturing processes are used to deformably press together under pressure body 116, portions 128 and 130 (of casing 132) and body 118 to form a locked together assembly desirable to realize structural integrity when propellant within casing wall 132 is ignited to propel a bullet (not shown) when assembled together and used as ammunition.

As shown in FIG. 8, inner body 116 has a primer hole 122 communicating with a flash hole 124. Depending on the manufacturing process, primer hole 122 and flash hole 124 can be stretched radially outwardly to swage, or work inner body 116 against ring, or ferrule portion 128 and outer rim primer body 118 of casing 132 as outer rim body 118 is worked in a radial inward direction. A radially outwardly extending rim flange 126 is formed from ferrule portion 128 which further locks in assembly with outer rim body 118 in assembly. A radially inwardly extending circumferential rib, or flange 119 is press-fit in stacked relation with casing wall 132 along proximal end portion 117 in roll-formed or pressed relation into a groove or trench of inner rim primer body 116.

Figure 9:
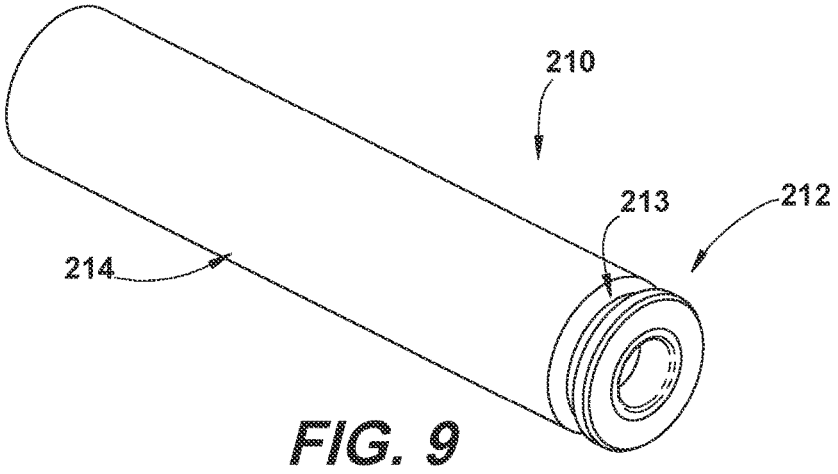
FIG. 9 is a perspective view from above and rearward of a third ammunition cartridge casing.

FIG. 9 is a perspective view from above and rearward of a third ammunition cartridge casing 210 having a multiple part base, or case rim 212, a casing body component 214 and a joint 213 formed to join together the base 212 and the body component 214. Joint 213 is provided to enable construction of cartridge casing 210 from multiple components and/or materials that optimize performance from one or more of weight, internal combustion pressures, conductivities and strengths. Cartridge casing 210 is used in the assembly of ammunition where a bullet, powder and primer are added to casing 210.

Figure 10:
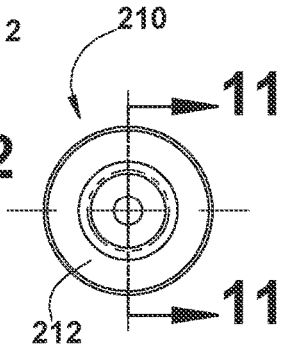
FIG. 10 is a rear end view of the cartridge casing of FIG. 9.

FIG. 10 is a rear end view of the cartridge casing 210 of FIG. 9. Case rim, or primer base 212 is shown in end view.

Figure 11:
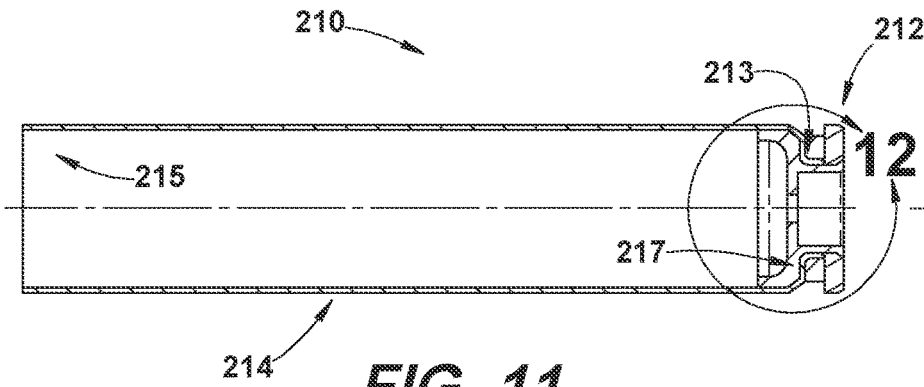
FIG. 11 is a vertical sectional view taken along line 11-11 of FIG. 10.

FIG. 11 is a vertical sectional view taken along line 10-10 of FIG. 10 showing detailed construction of joint 213 for ammunition casing 210. More particularly, casing body component, or wall 214 is formed at a proximal end to be locked within individual components making up multiple part base 212 to form connection joint 213 between component 214 and base 212. Casing body 214 has a distal end portion 215 and a proximal end portion 217. A projectile is received on distal end portion 215 of casing body 214.

Figure 12:
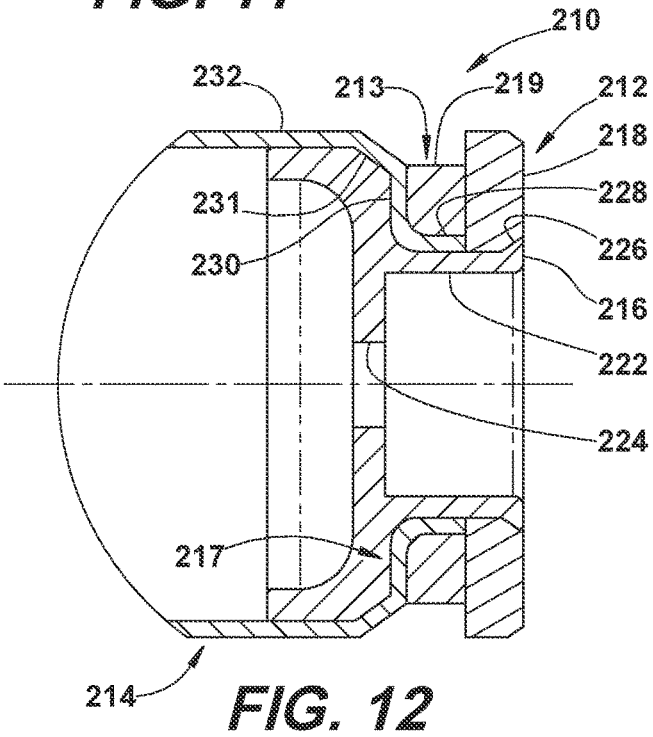
FIG. 12 is an enlarged sectional view from encircled region 12 of FIG. 11.

FIG. 12 is an enlarged sectional view from encircled region 12 of FIG. 11 showing greater details for joint 213 formed between component 214 and base 212 for cartridge casing 210. A proximal end portion 217 of component 214 forms an axially extending cylindrical leg 228. Leg 228 transitions via a radius to a radially outwardly extending flange 230. Flange 230 then transitions into a frustoconical portion 231. Component 214 comprises a stepped down casing wall 232 having a series of radially inwardly formed transitions having reduced diameter portions including frustoconical portion 231, radial extending portion 230, and terminating axial cylindrical portion, or leg 226. Flanges 228 and 230 and a radius therebetween cooperate to form a compound geometry formed by an end web of casing wall 232 that is trapped, or locked together in assembly between a cylindrical inner primer body 216 and a pair of cylindrical outer rim body portions 218 and 219. One of several manufacturing processes are used to press together body 216, portions 228 and 230 (of casing 232) and body 218 to form a locked together assembly desirable to realize structural integrity when propellant within casing 232 is ignited to propel a bullet (not shown) when assembled together and used as ammunition.

As shown in FIG. 12, inner body 216 has a primer hole 222 communicating with a flash hole 224. Depending on the manufacturing process, primer hole 222 and flash hole 224 can be stretched radially outwardly to swage, or work inner body 216 against ring, or ferrule portion 228 and outer rim body 218 of casing 232 as outer rim body 218 is worked in a radial inward direction. A radially outwardly extending rim flange 226 is formed from ferrule portion 228, which further locks in assembly with outer rim body 218 in assembly. A radially outwardly extending rim flange 226 can be worked, or formed during manufacturing in a distal end of body 216 along an outer edge of primer hole 222, adjacent flash hole 224 which serves to lock outer rim bodies 218 and 219 onto inner body 216.

Figure 13:
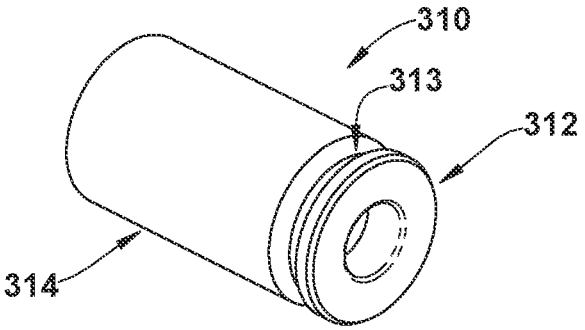
FIG. 13 is a perspective view from above and rearward of a fourth ammunition cartridge casing.

FIG. 13 is a perspective view from above and rearward of a fourth ammunition cartridge casing 310 having a multiple part base, or case rim 312, a casing body component 314 and a joint 313 formed to join together the base 312 and the body component 314. Joint 313 is provided to enable construction of cartridge casing 310 from multiple components and/or materials that optimize performance from one or more of weight, internal combustion pressures, thermal conductivities and strengths. Cartridge casing 310 is used in the assembly of ammunition where a bullet, powder and primer are added to casing 310

Figure 14:
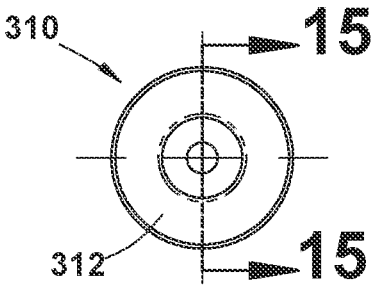
FIG. 14 is a rear end view of the cartridge casing of FIG. 13.

FIG. 14 is a rear end view of the cartridge casing 310 of FIG. 13. Case rim, or primer base 312 is shown in end view.

Figure 15:
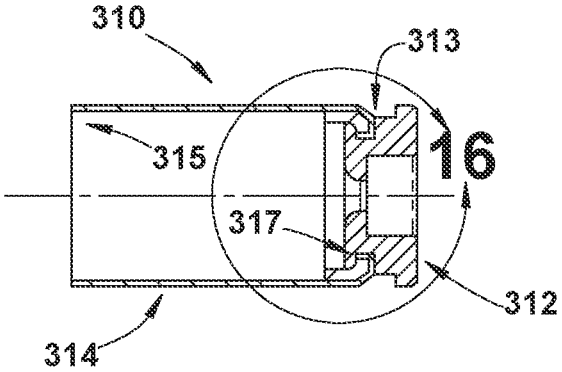
FIG. 15 is a vertical sectional view taken along line 15-15 of FIG. 14.

FIG. 15 is a vertical sectional view taken along line 15-15 of FIG. 14 showing detailed construction of joint 313 for ammunition casing 310. More particularly, casing body component, or wall 314 is formed at a proximal end to be locked within individual components making up multiple part base 312 to form connection joint 313 between component 314 and base 312. Casing body 314 has a distal end portion 315 and a proximal end portion 317. A projectile is received on distal end portion 315 of casing body 314.

Figure 16:
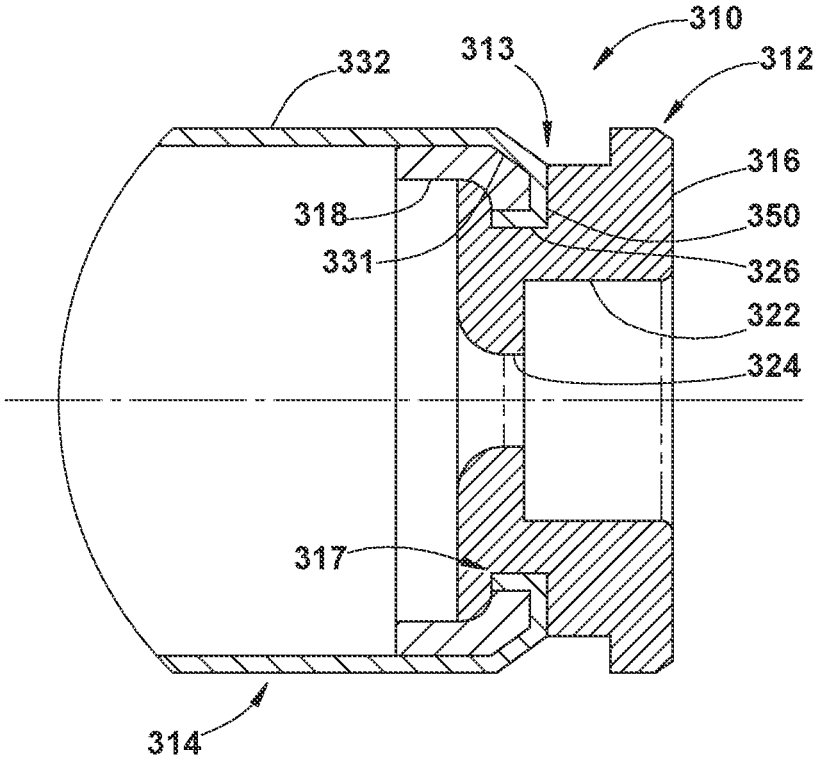
FIG. 16 is an enlarged sectional view from encircled region 16 of FIG. 15.

FIG. 16 is an enlarged sectional view from encircled region 16 of FIG. 15 showing greater details for joint 313 formed between component 314 and base 312 for cartridge casing 310. A proximal end portion 317 of component 314, namely casing wall 332, forms an inwardly extending frustoconical section 331, a radially inwardly extending circumferential flange 350, and an axially extending, inwardly folded circumferential flange 326. Flanges 326 and 350 and a right angle bend formed therebetween cooperate to form a compound geometry formed by an end web of casing wall 332 that is trapped, or locked together in assembly between a cylindrical inner primer body 316 and a cylindrical outer rim body portion, or ring 318. Rim body portion 318 includes a radially in-turned flange about which flanges 326 and 350 are locked into position. One of several manufacturing processes are used to press together body 316, portions 326 and 350 (of casing 332) and rim body portion 318 to form a locked together assembly desirable to realize structural integrity when propellant within casing wall 332 is ignited to propel a bullet (not shown) when assembled together and used as ammunition.

As shown in FIG. 16, inner body 316 has a primer hole 322 communicating with a flash hole 324. Depending on the manufacturing process, primer hole 322 and flash hole 324 can be stretched radially outwardly to swage, or work inner body 316 against flanges 326 and 350 and outer rim body portion 318 of casing wall 332 as outer rim body 318 is worked in a radial inward direction.

Figure 17:
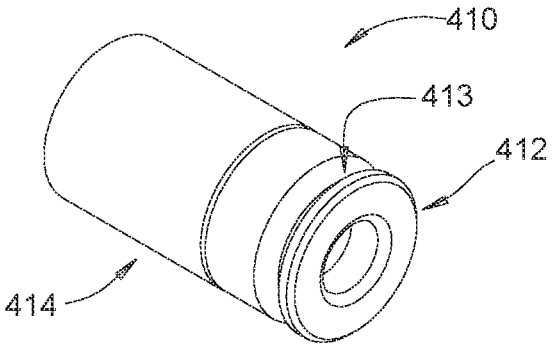
FIG. 17 is a perspective view from above and rearward of a fifth ammunition cartridge casing.

FIG. 17 is a perspective view from above and rearward of a fifth ammunition cartridge casing 410 having a multiple part base, or case rim 412, a casing body component 414 and a joint 413 formed to join together the base 412 and the body component 414. Joint 413 is provided to enable construction of cartridge casing 410 from multiple components and/or materials that optimize performance from one or more of weight, internal combustion pressures, conductivities and strengths. Cartridge casing 410 is used in the assembly of ammunition where a bullet, powder and primer are added to casing 110.

Figure 18:
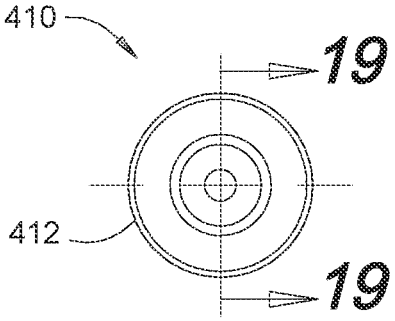
FIG. 18 is a rear end view of the cartridge casing of FIG. 17

FIG. 18 is a rear end view of the cartridge casing 410 of FIG. 17. Case rim, or primer base 412 is shown in end view.

Figure 19:
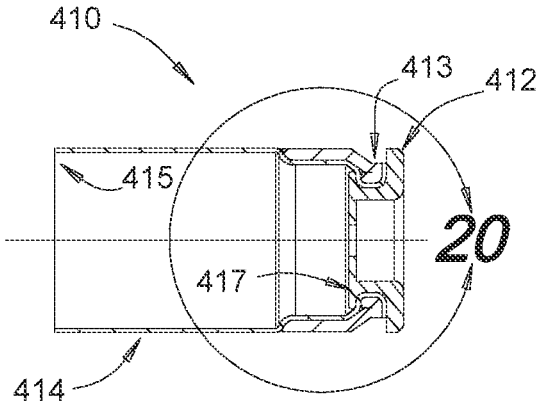
FIG. 19 is a vertical sectional view taken along line 19-19 of FIG. 18.

FIG. 19 is a vertical sectional view taken along line 19-19 of FIG. 18 showing detailed construction of joint 413 for ammunition casing 410. More particularly, casing body component, or wall 414 is formed at a proximal end portion 417 to be locked within individual components making up multiple part base 412 to form connection joint 413 between component 414 and base 412. A projectile is received on distal end portion 415 of casing body 414.

Figure 20:
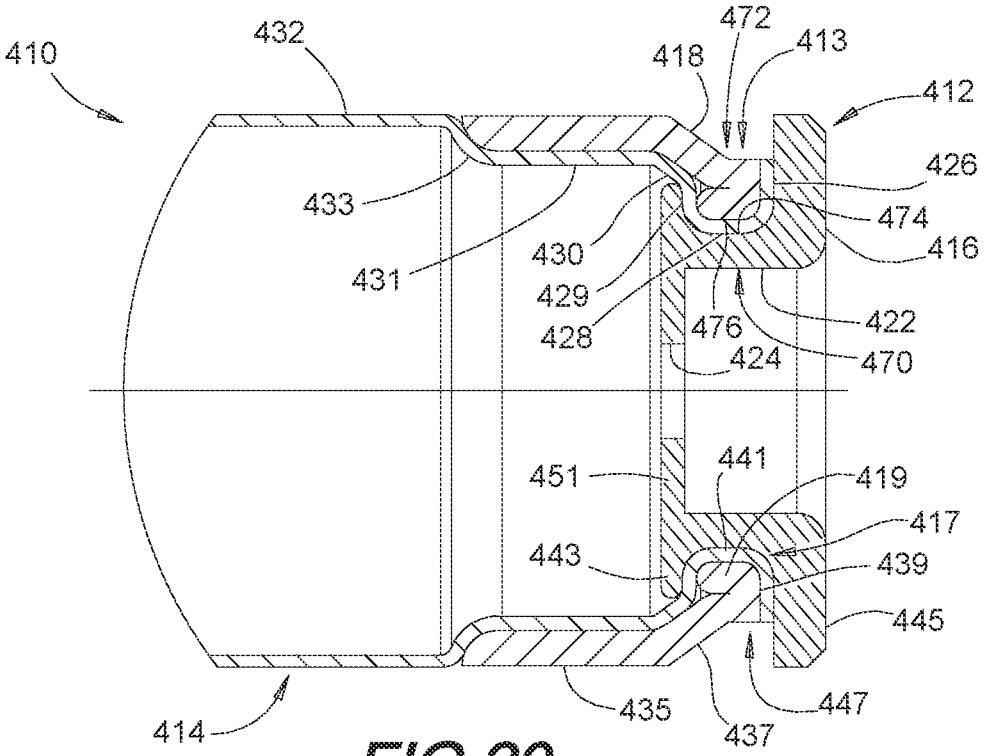
FIG. 20 is an enlarged sectional view from encircled region 20 of FIG. 19.

FIG. 20 is an enlarged sectional view from encircled region 20 of FIG. 19 showing greater details for joint 413 formed between component, or cartridge casing body 414 and base, or primer body 412 for cartridge casing 410. A proximal end portion 417 of cartridge casing body 414 formed by an axially extending tube, or wall 432 that is necked down in stages to form a cylindrical radially inwardly extending trench, or ring portion 428 within joint 413. Joint 413 forms a mechanical inter-lock between respective components. More particularly, cartridge casing body 414 comprises a stepped down casing wall 432 having a series of radius transitions formed by reduced diameter portions including radiused necked down portion 433 extending from cylindrical casing wall 432, axially extending cylindrical portion 431, necked down frustoconical portion 430 (optionally a radiused neck down portion), radially in-turned flange 429, axially extending cylindrical portion 428, and terminating proximal and radially outwardly extending rim flange 426. Flanges 429 and 426 and cylindrical portion 428 cooperate to form a compound geometry hub, or trench 447 formed by an end web, or portion of casing wall 432 and are trapped, or locked together in assembly between a cylindrical inner primer body 416 and a cylindrical outer primer body 418 under mechanical forming pressures. In one case, trench 447 has substantially parallel flanges 426 and 429. In other cases, one or more of such flanges 426 and 429 can extend radially outwardly at an angle, such as flange 128 in FIG. 8 and can be optionally pan shaped or have a curved radial shape similar to a cup washer. One of several manufacturing processes are used to press together body 416, portions 426, 428, 429 and 430 (of casing 432) and body 418 to form a locked together assembly forming mechanical interlocking joint 413 desirable to realize structural integrity when propellant within casing wall 432 is ignited to propel a bullet, or projectile (not shown) when assembled together and used as ammunition.

As shown in FIG. 20, inner body 416 has a primer hole 422 communicating with a flash hole 424 (a primer has been omitted for clarity). Depending on the manufacturing process, primer hole 422 and flash hole 424 formed in radially inwardly extending bulkhead, or flange 451 can be stretched radially outwardly to swage, or work inner body 416 against ring, or ferrule portion 428 and outer rim body 418 of casing 432 as outer rim body 418 is worked in a radial inward direction to forcibly and mechanically interlocked together such components in either a rolling or swaging operation. A radially outwardly extending rim flange 426 is formed to extend radially outwardly from cylindrical ferrule portion 428 which further locks in assembly with outer rim body 418 in assembly. A radially inwardly extending circumferential rib, or flange 419 is press-fit and mechanically deformed in stacked relation with casing wall 432 along proximal end portion 417 in roll-formed, swaged or pressed relation into a groove or trench 447 of inner rim primer body 416. Inner primer body, or portion 416 includes a cylindrical and radially inwardly formed trench 447 into which proximal end portion 417 forms circumferential well portion 441 contiguous with a pair of radially outwardly extending flanges, or disc portions 426 and 429 which nest in conformance within trench 447; namely along a radially outwardly extending circumferential wall portion 445, axially extending circumferential wall portion 474, and a radially outwardly extending circumferential wall portion 443. Outer primer body, or portion 418 is formed by a cylindrical wall portion 435, a frustoconical tapered portion 437 and a radially inwardly formed flange 439 that includes a radially innermost cylindrical wall portion, or rib, or bulkhead 419 that is mechanically deformed into trench 447 during mechanical deformation loading in one of a roll-forming, swaging or press fit operation. Such construction of joint 413 is provided to contain higher combusting propellent pressures. Inner primer body 416 has an inner ring portion 470 with an outer surface 474 that mates along with proximal end, or ferrule portion 417 of casing 432 in press-fit and mechanically deformed stacked relation with an inner surface 475 on an outer ring portion 472 on outer primer body 418.

Figure 21:
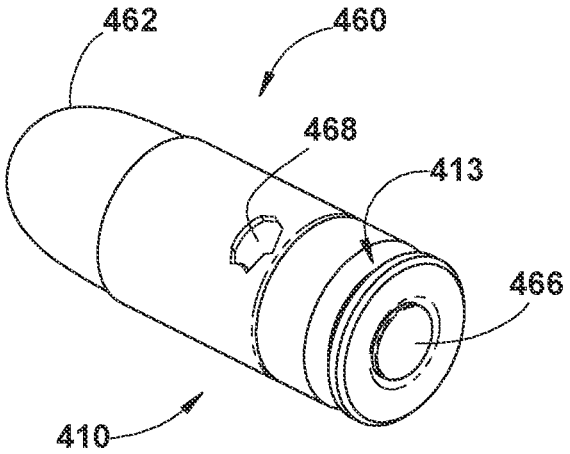
FIG. 21 is a left rear perspective view of a pistol ammunition cartridge with a portion broken away and utilizing the ammunition cartridge casing of FIGS. 17-20.

FIG. 21 is a left rear perspective view of a pistol ammunition cartridge 460 with a portion broken away and utilizing the ammunition cartridge casing 410 with a casing joint 413 as depicted in FIGS. 17-20. Optionally, any of the casing joints depicted in FIGS. 1-16 can be utilized. More particularly, pistol ammunition cartridge 460 includes a projectile, or bullet 462, a primer 466, and a charge, or quantity of propellant, or gun powder 468 within cartridge casing 410. Projectile 462 is sealed within an open distal end of cartridge casing 410. Primer 466 is installed in a casing base of cartridge casing 410 near a mechanical interlock, or joint 413 between a casing wall and a primer base of the cartridge casing 410.

Figure 22:
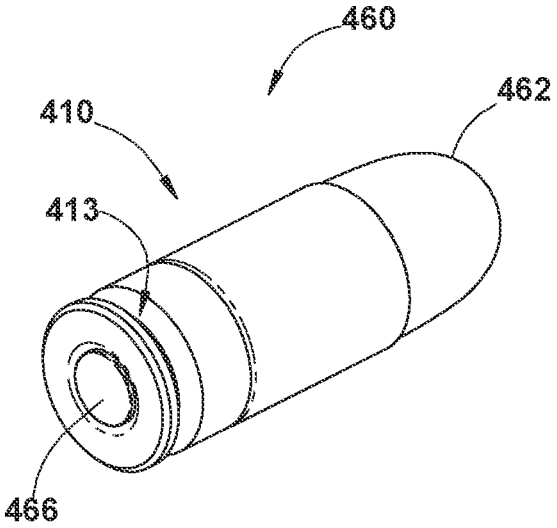
FIG. 22 is a right rear perspective view of the pistol ammunition cartridge of FIG. 21.

FIG. 22 is a right rear perspective view of the pistol ammunition cartridge 460 of FIG. 21. Projectile 462 and primer 466 are shown affixed to cartridge casing 410 with primer 462 proximate casing joint 413.

Figure 23:
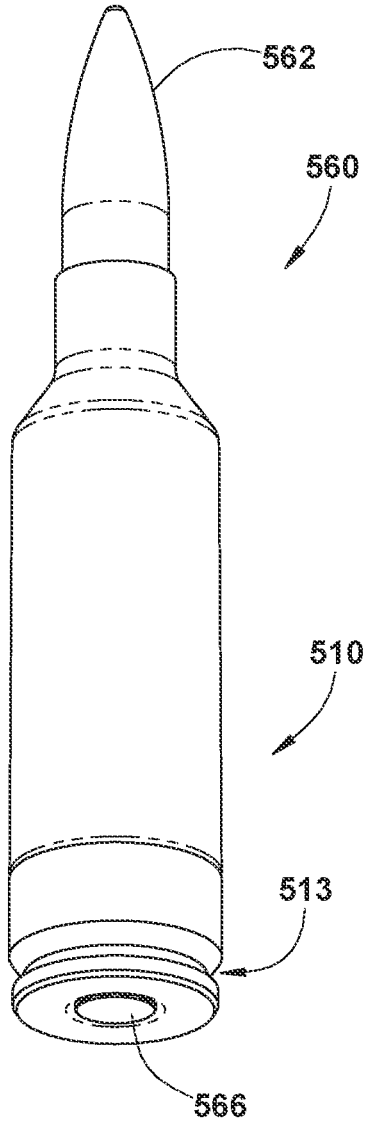
FIG. 23 is a perspective view from above of a rifle ammunition cartridge utilizing an ammunition cartridge casing having a casing joint similar to that depicted in FIGS. 17-20.

FIG. 23 is a perspective view from above of a rifle ammunition cartridge 560 utilizing an ammunition cartridge casing 510 having a casing joint 513 similar to that depicted in FIGS. 17-20. Optionally, any of the casing joints depicted in FIGS. 1-16 can be utilized. A projectile 562 and a primer 566 are shown affixed to cartridge casing 410 with primer 462 proximate casing joint 413.

For the purposes of explaining the cartridge casings 10, 110, 210, 310, 410 and 510 of FIGS. 1-23, the portion that comprises the body, shoulder, neck and mouth will be a first part, shown as the casing wall 32, 132, 232, 332 and 432 in FIGS. 1-20. The portion that forms the central piece also known as the case web, the piece that supports the part not supported by barrel or bolt, will be a second part, also shown as the portion of casing 10, 110, 210, 310 and 410 locked in the joint 13, 113, 213, 313 and 413. The part that comprises the case rim is a third part, also shown as the multiple part base, or case rim 12, 112, 212, 312 and 412.

The casing wall (32, 132, 232 and 323), according to some constructions, will be formed through deep draw, extrusion, injection molding, or lathe turning including Swiss turns. The most optimal way of forming this part is deep draw. The key component to this in our case design is a very thin, yet uniform wall. The material will likely be stainless steel or cartridge brass. It could also be comprised of plastic, composite materials, aluminum, ferrous metals and we should include copper. These are less likely to be used, especially copper.

The portion of casing 10, 110, 210 and 310 locked in the joint 13, 113, 213 and 313 forms a web that will be formed through deep draw, swaging, turning, injection molding to include metal-injection-molding (MIM) and amorphous metal. It can also include 3D printing using advancements that are taking place in that arena.

The multiple part base, or case rim 12, 112, 212 and 312 will be formed through turning, swaging, mechanical working of metal parts, injection molding (MIM or amorphous), but likely not plastic, though it can be included in some instances. Swaging and turning are the primary ways to form. It will be comprised of aluminum, steel, brass, plastic, amorphous metal. Steel is one optimal material.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

I claim:

1. An ammunition cartridge casing, comprising:

a primer body having an inner primer portion and an outer primer portion, an outer surface of the inner primer portion providing a circumferential trench having a radially outwardly extending first circumferential wall portion, a radially outwardly extending second circumferential wall portion, and an axially extending circumferential wall portion extending contiguously between the first circumferential wall portion and the second circumferential wall portion, the outer primer portion configured to nest in conformance within the circumferential trench; and a casing body having a distal end portion and a proximal end portion, the proximal end portion of the casing body interposed in nested conformance between the inner primer portion and the outer primer portion within the trench to interlock a complementary axially extending circumferential wall portion and complementary first and second circumferential wall portions of the casing body between the inner primer portion and the outer primer portion.

2. The ammunition cartridge casing of claim 1, wherein the inner primer portion of the primer body comprises a U-shaped trench having a pair of radially outwardly extending circumferential wall portions and an axially extending circumferential wall portion interposed between the pair of radially inwardly extending circumferential wall portions.

3. The ammunition cartridge casing of claim 2, wherein the outer primer portion of the primer body comprises a cylindrical outer rim body having a radially inwardly extending circumferential flange configured to nest in press fit relation with the proximal end portion of the casing body within the circumferential trench of the inner primer body portion.

4. The ammunition cartridge casing of claim 3, wherein the pair of radially outwardly extending circumferential wall portions are substantially parallel.

5. The ammunition cartridge casing of claim 3, wherein the radially inwardly extending circumferential flange comprises a folded radial innermost flange portion of the radially extending circumferential flange.

6. The ammunition cartridge casing of claim 3, wherein the radially extending circumferential flange comprises a ring-shaped radially inwardly extending circumferential bulkhead formed with the proximal end portion of the casing wall circumferentially within the trench of the inner primer portion to form a mechanical press fit interlocking joint between the casing body and the primer body.

7. The ammunition cartridge casing of claim 2, wherein each of the pair of radially inwardly extending circumferential wall portions of the inner primer portion of the primer body extend at a right angle to the axially extending circumferential wall portion of the inner primer portion of the primer body.

8. The ammunition cartridge casing of claim 1, wherein the interlocked axially extending circumferential wall portion of the casing body and the interlocked radially outwardly extending disc portion of the casing body extend at a right angle to one another.

9. The ammunition cartridge casing of claim 8, wherein another radially extending wall portion of the casing body is formed contiguous with the axially extending circumferential wall portion of the casing body spaced at an opposed end of the axially extending circumferential wall portion.

10. The ammunition cartridge casing of claim 9, wherein the radially extending wall portions of the casing body and the axially extending circumferential wall portion of the casing body are interlocked in a mechanical deformation forming operation between the inner primer portion and the outer primer portion of the primer body to form a circumferential lock joint.

11. The ammunition cartridge casing of claim 1, wherein one of the inner primer portion and the outer primer portion of the primer body is made from one metal or metal alloy and the casing body is made from another metal or metal alloy different from the one metal or metal alloy.

12. An ammunition cartridge casing, comprising:

a primer body having an inner primer portion with an inner ring portion and an outer primer portion with an outer ring portion, the outer ring portion having an inner surface configured to nest in conformance with an outer surface of the inner ring portion, the outer surface of the inner ring portion providing a circumferential trench having a radially outwardly extending first circumferential wall portion, a radially outwardly extending second circumferential wall portion, and an axially extending circumferential wall portion; and a casing body having a distal end portion and a proximal end portion, the proximal end portion of the casing body interposed between the inner ring portion and the outer ring portion within the trench having an axially extending circumferential portion and a radially outwardly extending wall portion of the casing body interlocked between the inner ring portion and the outer ring portion.

13. The ammunition cartridge casing of claim 12, wherein the inner ring portion comprises a hub having a radially inwardly extending trench.

14. The ammunition cartridge casing of claim 13, wherein the outer ring portion comprises a radially inwardly extending circumferential wall portion configured to nest with a portion of the proximal end portion of the casing body within the trench.

15. The ammunition cartridge casing of claim 14, wherein the radially inwardly extending circumferential wall portion of the outer ring portion nests in press fit relation with the proximal end portion of the casing wall within the circumferential trench of the inner ring portion.

16. The ammunition cartridge casing of claim 12, wherein the inner ring portion of the inner primer portion and the outer ring portion of the outer primer portion cooperate with the proximal end portion of the casing body to form an ammunition casing joint.

17. The ammunition cartridge casing of claim 16, wherein the proximal end portion of the casing body is interposed between the inner ring portion and the outer ring portion within the trench to provide an interlocked axially extending circumferential portion and an interlocked radially outwardly extending wall portion of the casing body.

18. The ammunition cartridge casing of claim 16, wherein the outer surface of the inner ring portion of the inner primer portion comprises a U-shaped trench having a pair of radially outwardly extending circumferential wall portions and an axially extending circumferential portion interposed between the pair of radially inwardly extending circumferential wall portions.

19. The ammunition cartridge casing of claim 18, wherein the radially inwardly extending circumferential flange is a press-fit and mechanically deformed circumferential flange provided in stacked relation with the proximal end portion of the casing wall within the U-shaped trench of the inner ring portion of the inner primer portion.

20. The ammunition cartridge casing of claim 18, wherein the inner surface of the outer ring portion of the outer primer portion comprises a cylindrical outer rim body having a radially inwardly extending circumferential flange configured to nest in press fit relation with the proximal end portion of the casing wall within the circumferential trench of the inner primer body portion.

21. The ammunition cartridge casing of claim 12, wherein the deformed circumferential flange comprises a ring-shaped radially inwardly extending circumferential bulkhead formed with the proximal end portion of the casing wall circumferentially within the trench of the inner ring portion of the inner primer portion to form a mechanical press fit interlocking joint between the casing body and the primer body.

22. The ammunition cartridge casing of claim 12, wherein the interlocked axially extending circumferential wall portion of the casing body and the interlocked radially outwardly extending wall portion of the casing body extend at a right angle to one another.

23. The ammunition cartridge casing of claim 12, further comprising another radially extending wall portion provided along the casing body formed contiguous with the axially extending circumferential wall portion of the casing body spaced at an opposed end of the axially extending circumferential wall portion to form a ferrule portion.

24. The ammunition cartridge casing of claim 12, wherein the radially extending wall portions of the casing body and the axially extending circumferential wall portion of the casing body are interlocked in a mechanical deformation forming operation to form a circumferential lock joint along the ferrule portion of the casing body.

* * * * *